US009303922B2

(12) United States Patent
Bhadurt et al.

(10) Patent No.: US 9,303,922 B2
(45) Date of Patent: Apr. 5, 2016

(54) METHOD AND APPARATUS FOR ACHIEVING HIGHER COOLING RATES OF A GAS DURING BYPASS COOLING IN A BATCH ANNEALING FURNACE OF COLD ROLLING MILLS

(71) Applicant: Tata Steel Limited, Jamshedpur (IN)

(72) Inventors: Jayabrata Bhadurt, Jamshedpur (IN); Deb Roy, Jamshedpur (IN); Subhrakanti Chakraborty, Jamshedpur (IN); Shantanu Chakraborty, Jamshedpur (IN); Sumitesh Das, Jamshedpur (IN); Debashish Bhattacharjee, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 137 days.

(21) Appl. No.: 14/077,627

(22) Filed: Nov. 12, 2013

(65) Prior Publication Data

US 2014/0145381 A1 May 29, 2014

Related U.S. Application Data

(62) Division of application No. 13/142,558, filed as application No. PCT/IN2009/000243 on Apr. 20, 2009, now Pat. No. 9,074,818.

(30) Foreign Application Priority Data

Feb. 16, 2009 (IN) ..... 292/KOL/2009

(51) Int. Cl.

| | |
|---|---|
| ***B21C 9/00*** | (2006.01) |
| ***F27D 9/00*** | (2006.01) |
| ***B21B 45/02*** | (2006.01) |
| ***F27D 19/00*** | (2006.01) |
| ***C21D 1/767*** | (2006.01) |
| ***C21D 1/74*** | (2006.01) |
| ***C21D 1/76*** | (2006.01) |
| ***C21D 11/00*** | (2006.01) |

(52) U.S. Cl.

CPC ..... *F27D 9/00* (2013.01); *B21B 45/0224* (2013.01); *C21D 1/74* (2013.01); *C21D 1/76* (2013.01); *C21D 1/767* (2013.01); *C21D 11/005* (2013.01); *F27D 19/00* (2013.01)

(58) Field of Classification Search

CPC ..... F27D 19/00; F27D 9/00
USPC ..... 266/256
See application file for complete search history.

(56) References Cited

U.S. PATENT DOCUMENTS

| | | | | |
|---|---|---|---|---|
| 3,366,163 | A * | 1/1968 | Scharbrough | 165/300 |
| 4,543,891 | A | 10/1985 | O'Sullivan et al. | |
| 5,380,378 | A * | 1/1995 | Hemsath | 148/601 |
| 2005/0269547 | A1 | 12/2005 | Ohira et al. | |
| 2012/0024516 | A1 * | 2/2012 | Bhadurt et al. | 165/200 |

FOREIGN PATENT DOCUMENTS

| | | | |
|---|---|---|---|
| EP | 1506987 | A1 | 2/2005 |
| JP | 58091131 | A | 5/1983 |

* cited by examiner

*Primary Examiner* — Scott Kastler
(74) *Attorney, Agent, or Firm* — The Webb Law Firm

(57) ABSTRACT

A method and apparatus to increase the cooling rate of gas used in a batch annealing furnace of cold rolling mills under bypass cooling. The invention makes use of the higher heat transfer capacities of nanocoolants developed by a high-shear mixing of nanoparticles and stabilizers in a basic aqueous medium for cooling heated hydrogen flowing through a heat exchanger during bypass cooling of the batch annealing furnace. The nanofluid is prepared in a nanofluid preparation unit.

5 Claims, 3 Drawing Sheets

METHOD AND APPARATUS FOR ACHIEVING HIGHER COOLING RATES OF A GAS DURING BYPASS COOLING IN A BATCH ANNEALING FURNACE OF COLD ROLLING MILLS

CROSS REFERENCE TO RELATED APPLICATIONS

This application is a divisional application of U.S. patent application Ser. No. 13/142,558, filed Jun. 28, 2011, now U.S. Pat. No. 9,074,818, which is a 371 of PCT/IN2009/000243 filed Apr. 20, 2009, which claims benefit of priority from Indian Patent Application No. 292/KOL/2009 filed Feb. 16, 2009, all of which are incorporated herein by reference for all purposes, in their entireties.

FIELD OF INVENTION

This invention relates to a method for achieving higher cooling rates of hydrogen during bypass cooling in a batch annealing furnace of cold rolling mills. The invention further relates to an apparatus for implementing the method.

BACKGROUND OF INVENTION

In a cold rolling mill, hot rolled steel strips are rolled at room temperature to achieve improved surface quality and mechanical properties of the final cold rolled products. However, extensive deformation of the steel at room temperature during the cold rolling operation significantly reduces the ductility of the cold rolled sheets. In order to render the cold rolled sheets amenable for subsequent operations, e.g. deep drawing of auto body parts, the cold rolled steel coils need to be annealed.

During the annealing operation, deformed microstructures of the cold rolled sheets are stress relieved, and accordingly recovery, recrystallisation, and grain growth take place.

Thus, the cold Rolled steel coils need to be annealed to obtain desired metallurgical properties in terms of strength and ductility levels. To achieve this, this cold rolled steel coils are stacked one above other and placed in a heating chamber. The heating chamber heats the coils to temperatures of 400-500° C. The heating process is followed by a cooling cycle. The cooling cycle uses hydrogen to take the heat away indirectly by cooling a hood of the furnace. Efficiency of the cooling cycle depends on the rate at which heat can be extracted from the hydrogen within the confinements of the system.

Batch annealing furnace typically comprise a base unit provided with a recirculation fan and cooling means. On the base unit, several cold rolled steel coils are placed one above the other, separated by a plurality of circular convector plates. These cylindrical shaped coils with outer diameter (OD) in the range of 1.5-2.5 m, inner diameter (ID) 0.5-0.7 m, and widths of 1.0-1.4 m, weigh around 15-30 t each. These are the typical data, which widely vary from plant to plant depending upon the overall material design. After loading the base with the coils, a protective, gas tight cylindrical cover is put in place and hydrogen gas is circulated within this enclosure. A cylindrical hood for the gas or oil fired furnace hood is placed over this enclosure. The protective cover is externally heated through radiative and convective modes of heat transfer, which heats the circulating hydrogen gas. The outer and inner surfaces of the coils get heated by convection from the circulating hydrogen gas and by radiation between the cover and the coil. The inner portions of the coils are heated by conduction.

During the cooling cycle, the furnace hood is replaced with a cooling hood and the circulating gas is cooled.

There are generally three known strategies that are followed in batch annealing furnace, namely:

(a) AIR/JET cooling in which compressed air hits the cooling hood at high pressures.

(b) SPRAY cooling in which water is sprayed directly onto the cooling hood.

(c) BY-PASS cooling in cooling in which a gas flowing in the inner cover is tapped and cooled, using a heat exchanger. The efficiency of the heat exchanger determines the rate of cooling of the gas.

Commonly used mechanism for increasing the heat transfer rate, are:

(a) Increasing the number of tubes and corrugations per tube inside the heat exchanger.

(b) Using water at a lower temperature obtained from a chilled water line.

Both methods (a) and (b) are costly and hence do no find acceptance under the present circumstances.

OBJECTS OF INVENTION

It is therefore an object of the present invention to propose a process for achieving high cooling rates of a heated gas in a batch annealing furnace of cold rolling mills.

Another object of the present invention is to propose a process for achieving higher cooling rates of a heated gas in a batch annealing furnace of cold rolling mills, which is implemented during the bypass cooling mode.

A further object of the invention is to propose an apparatus for achieving higher cooling rates of an atmospheric gas in a batch annealing furnace of cold rolling mills.

SUMMARY OF INVENTION

Accordingly in a first aspect of the invention there is provided an apparatus for achieving higher cooling rates of a gas during bypass cooling in a batch annealing furnace of cold rolling mills, comprising a nanocoolant preparation unit for preparing a nanofluid, and for supplying the nanofluid to a heat exchanger at a described flow rate, temperature and pressure, the nanofluid being prepared by mixing industrial grade water with nanoparticles including dispersants by adapting a high speed shear mixture. A batch annealing furnace accommodating the cold rolled steel coils on a base and heating the coils by placing a furnace hood on the top, the furnace having a cooling hood, a gas inlet and a gas outlet.

The hydrogen gas from the heat exchanger is allowed to enter the furnace via the gas inlet, the cooled hydrogen exiting the heat exchanger via the gas outlet. A heat exchanger receiving the nanofluid from a reservoir at a desired flow-rate, the reservoir being supplied with the nanofluid from the preparation unit, the nanofluid exchanging heat with the hydrogen at a higher rate, and exiting via an outlet provided in the heat exchanger.

According to a second aspect of the invention, there is provided a method for achieving a higher cooling rate of hydrogen during bypass cooling in a batch annealing furnace of cold rolling mills, the method comprising the steps of filling-up of the preparation unit with industrial grade water maintained at ambient condition. Measuring in a first measuring and control device the nanoparticles including dispersants at a lot-size determined based on the type of steel coils to be cooled. The first device is controlling the flow rates, pressure, and temperature of the produceable nanofluid to be supplied to the heat exchanger. Mixing the nanoparticles including the dispersants with the industrial grade water at a preferable volumetric ratio of 0.1% in the preparation unit. Supplying the prepared nanofluids from the preparation unit to the reservoir by using a pump. Delivering the hydrogen gas to the heat exchanger at a temperature between 400 to 600° C., and delivering the nanofluid at a predetermined flow-rate, temperature, and pressure from the reservoir to the heat exchanger. Supplying the hydrogen gas from the heat exchanger to the furnace for cooling the heated steel coils and the hydrogen being returned to the heat exchanger from the furnace. The nanofluids is delivered to the heat exchanger exchanging the heat within the hydrogen; and the nanofluid exiting the heat exchanger via a first outlet. The cooled hydrogen exiting the heat exchanger via a second outlet, the hydrogen getting cooled at a rate between 1 to 2° C./min.

BRIEF DESCRIPTION OF THE ACCOMPANYING DRAWINGS

DETAIL DESCRIPTION OF THE INVENTION

The present disclosure covers the following main aspects of the invention:

(a) Nanocoolant preparation process
(b) Batch Annealing furnace process
(c) Proposed Circuit for achieving higher cooling rates of hydrogen.

Nanocoolant Preparation Process

Nanocoolants are aqueous based solution having controlled volumes of stable dispersions of nano-sized oxide particles. Commonly used nano-sized particles are oxides of alumina, copper and titanium that exhibit higher heat transfer capacities compared to the bulk oxides of alumina, copper and titanium.

Nanosized particles of the oxides species of alumina, copper, titanium are prepared using a high speed mixer as described in our Patent application no; 293/KOL/09 dated 16 Feb. 2009.

Batch Annealing Process

Figure 2:
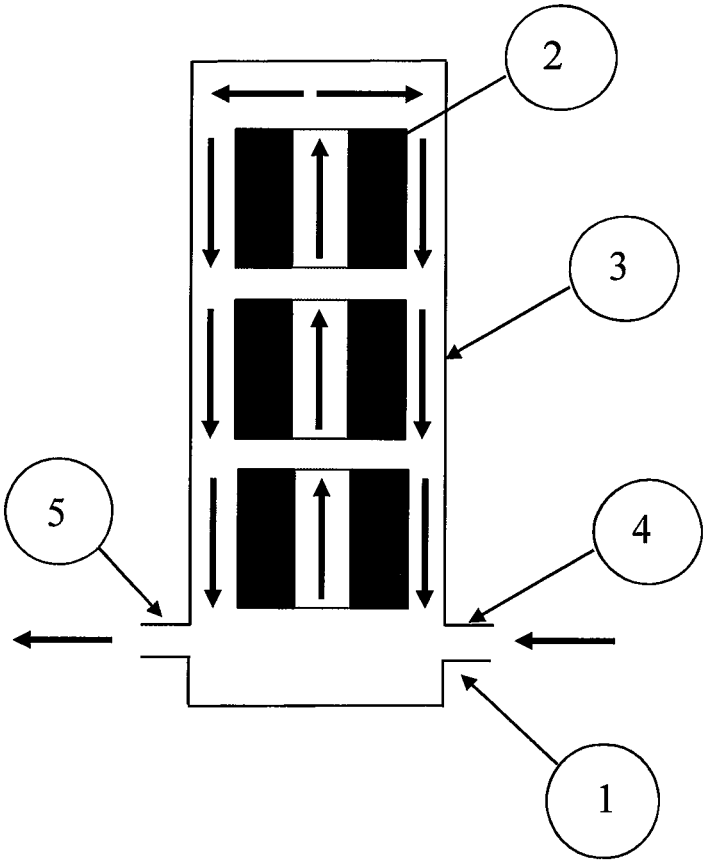
FIG. 2 shows a detailed layout of a batch annealing process of FIG. 1.

Cold Rolled steel coils need to be annealed to obtain desired metallurgical properties in terms of strength and ductility levels. To achieve this, the cold rolled steel coils are stacked one above other and placed in a heating chamber. The heating process heats the coils to a temperature of 400~500° C. The heating process is followed by a cooling cycle. The cooling cycle uses hydrogen to take the heat away indirectly by cooling a cooling hood (3). FIG. 2 shows the schematic arrangement.

During the cooling process, hydrogen enters the hood (3) through an ambient gas inlet (4), and picks up the heat by convection from the surface of the coils (2) and comes out of the hood (3) through a hot gas outlet (5).

To ensure the effectiveness of the cooling process, it is essential to cool down the hydrogen so that it enters the hood (3) at near ambient temperature. For this, a commercially available gas-liquid heat exchanger (B) is employed.

Figure 1:
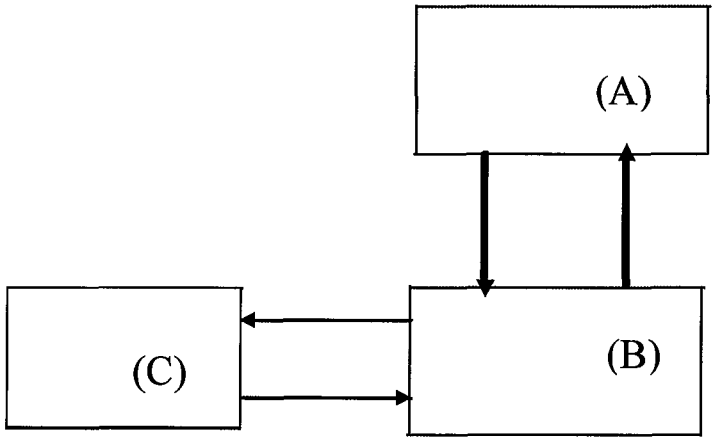
FIG. 1 is a schematic view showing the operating principle of the invention.

FIG. 1 shows a schematic overall view depicting the principle of the present invention. In a batch annealing furnace (A), cold rolled steel coils (2) are stacked and heated to a temperature of 400 to 500° C. The heating process is followed by a cooling cycle in a heat exchanger (B) which uses hydrogen gas. The batch annealing furnace (A) as shown in FIG. 2, comprises a base (1) for loading the cold rolled steel coils (2), a cooling hood (3) to allow entry of the hydrogen gas through an ambient gas inlet (4) which picks up the heat by convection from the surface of the coils (2) and exits the furnace (A) via a hot gas outlet (5).

Figure 3:
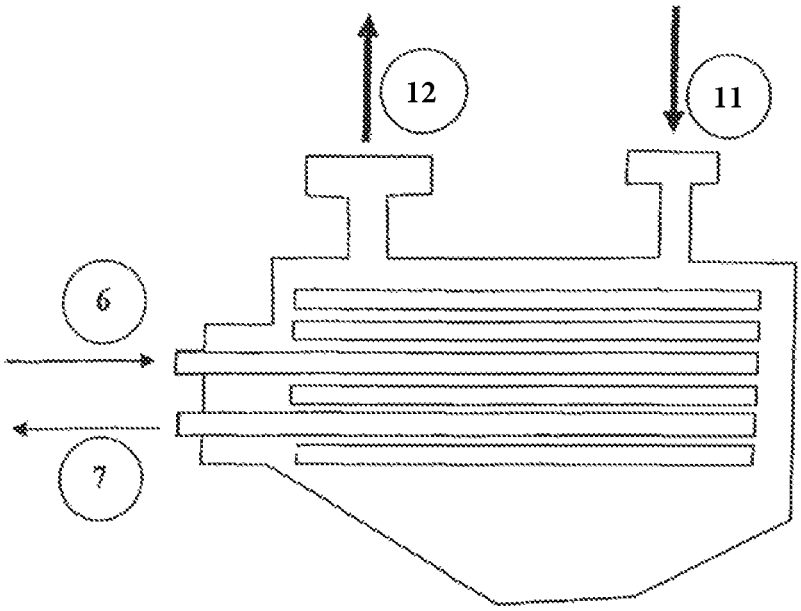
FIG. 3 shows a detailed view of the heat exchanger of FIG. 1.

FIG. 3 shows a details of the heat exchanger (B) of FIG. 1. The heat exchanger (B) is having an inlet (6) for the nanofluid to enter the heat exchanger (B) from a Nanofluid preparation unit (C). After exchanging the heat, the nanofluid is allowed to exit through a nanocoolant outlet (7).

Figure 4:
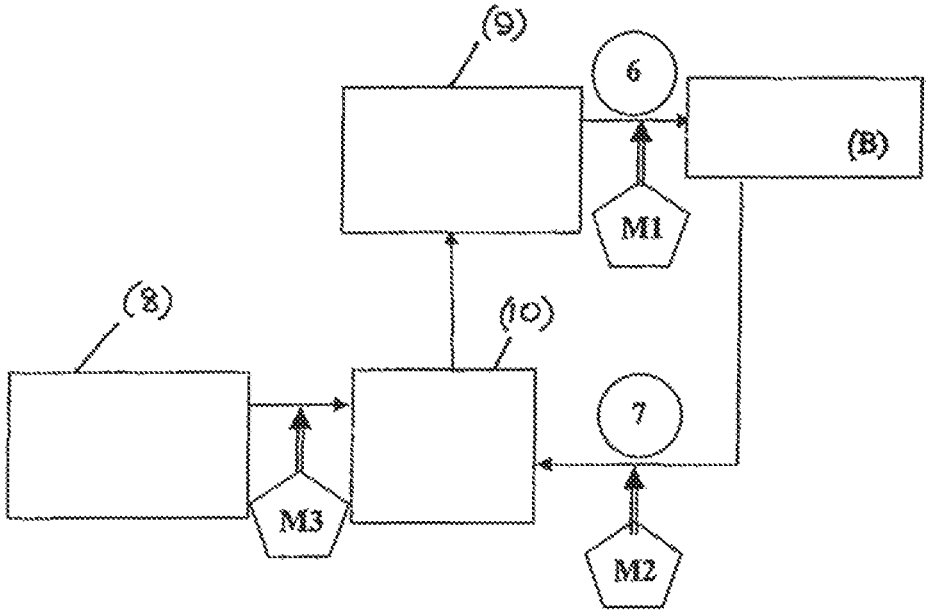
FIG. 4 shows a detailed view of a nanocoolant—preparation unit of FIG. 1.

FIG. 4 shows details of the nanofluid preparation unit (C) of FIG. 1. The unit (C) comprises a mixing device (8) in which industrial grade water and nanoparticles including dispersants in a volumetric ratio of 0.1% is mixed in ambient conditions. A pump is utilized to supply the nanofluid from the mixing device (8) to a reservoir (10). From the reservoir (10) the nanofluid is pumped into the heat exchanger (B) by a pumping unit (9) via an outlet (7). The nanocoolant preparation unit (C) further comprises a first measurement and control device (M1) for controlling the flow rates, temperature, and pressure of the nanocoolant to be supplied to the heat exchanger (B); and a second measurement and control device (M2) for measurement of the nanocoolant exiting from the heat exchanger (B) including flow rates, temperature and pressure; and a third measurement and control device (M3) for measuring the ppm and pH level of the nanocoolant in the preparation unit (C).

The operation process is as follows:

(a) Industrial grade water is filled up in the nanocoolant mixer (8) to a capacity of 1000 liters.
(b) Temperature of the industrial grade water is maintained between 20~30° C. i.e. ambient conditions. No preprocessing of the industrial grade water is done.
(c) Nanoparticles are measured by a measuring unit (M1) in lot sizes of 250 gms along with dispersants in lot sizes of 250 gms.
(d) The quantity is decided on the basis of a pre-determined operating rule, for example, of 1 gram in 1 liter of industrial grade water. This is a volumetric ratio of 0.1%.
(e) The lot sizes of the nanoparticles can vary depending on the coil type and weight of the steel coils (2) being cooled.
(f) The mixing is done using the high speed shear Nanocoolant Mixer (8).
(g) The mixing is completed within 1 to 2 minute after the nanoparticles and dispersants are added to the system.
(h) A pump (not shown) is used to fill up the Nanocoolant reservoir (10). This Nanocoolant reservoir (10) now has the nanofluid.
(i) Hydrogen gas enters the heat exchanger (B) through the inlet (11) at a temperature of 525~425° C. at a flow rate of 20-40 $m^3$/hr.
(j) Nanofluid from the reservoir (10) is pumped-out by a Nanocoolant Pumping unit (9), and delivered into the heat exchanger (B) through the inlet (6) at a flow rate of 20-40 $m^3$/hr.
(k) The nanofluid exchanges heat with the hydrogen in the heat exchanger (B).

(l) The cooled hydrogen exits the heat exchanger (B) through the outlet (12).

(m) The nanofluid exits the heat exchanger (B) through an outlet (7).

(n) The hydrogen is cooled at a rate of 1.21.5° C./min using the nanofluid.

(o) When steps (a) to (m) are repeated with industrial grade water without the nanofluid, all other parameters remaining same, the hydrogen is cooled at a rate of 0.8~1.0° C./min, according to the present invention.

This means that using the method and apparatus of the invention, higher cooling rates of hydrogen of the order of 1.2~1.5° C./sec can be obtained.

The invention claimed is:

1. An apparatus for achieving higher cooling rates of a gas during bypass cooling in a batch annealing furnace, comprising:

a nanocoolant preparation unit for preparing a nanofluid, and for supplying the nanofluid to a reservoir at a desired flow rate, temperature and pressure, the nanofluid being prepared by mixing industrial grade water with nanoparticles including dispersants using a high speed shear mixer;

a heat exchanger having a nanofluid inlet and a nanofluid outlet, the heat exchanger receiving the nanofluid from the reservoir through the nanofluid inlet at a desired flow-rate and returning the nanofluid to the reservoir through the nanofluid outlet, the reservoir being supplied with the nanofluid from the preparation unit, wherein the nanofluid exchanges heat with hydrogen and exits the heat exchanger via an outlet provided in the heat exchanger;

a first measurement and control unit located between the reservoir and the nanofluid inlet, a second measurement and control unit located between the nanofluid outlet and the reservoir, and a third measurement and control unit located between the nanocoolant preparation unit and the reservoir;

a batch annealing furnace having a base for accommodating cold rolled steel coils, a furnace hood for heating the coils, a cooling hood for cooling the coils, a gas inlet, and a gas outlet, wherein cooled hydrogen gas from the heat exchanger enters the furnace via the gas inlet and heated hydrogen exits the furnace via the gas outlet.

2. The apparatus as claimed in claim 1, comprising a pump for supply of the nanofluid from the preparation unit to the reservoir.

3. The apparatus as claimed in claim 1, comprising a pumping unit for delivering the nanofluid from the reservoir to the heat exchanger.

4. The apparatus as claimed in claim 1, wherein the heat exchanger is a gas-fluid shell tube or plate-type heat exchanger.

5. The apparatus as claimed in claim 1, wherein the first measurement and control device and the second measurement and control device measure and control at least one of temperature, flow rate, and pressure.

* * * * *

UNITED STATES PATENT AND TRADEMARK OFFICE

CERTIFICATE OF CORRECTION

PATENT NO. : 9,303,922 B2
APPLICATION NO. : 14/077627
DATED : April 5, 2016
INVENTOR(S) : Jayabrata Bhadurt et al.

It is certified that error appears in the above-identified patent and that said Letters Patent is hereby corrected as shown below:

In the claims,

Column 6, Line 23, Claim 4, delete "plate-type" and insert -- plate --

Signed and Sealed this
Nineteenth Day of July, 2016

Michelle K. Lee

Michelle K. Lee
*Director of the United States Patent and Trademark Office*